166-250 SR
FIP8011 OR 3,968,839

United States Patent [19]
Swihart, Sr.

[11] 3,968,839
[45] July 13, 1976

[54] SUBSURFACE FLOW CONTROL APPARATUS

[76] Inventor: Patrick S. Swihart, Sr., 3507 Baumann, Midland, Tex. 79701

[22] Filed: Mar. 21, 1975

[21] Appl. No.: 560,350

[52] U.S. Cl. ..... 166/250; 166/53; 166/224 R; 166/314

[51] Int. Cl.[2] ..... E21B 43/00; E21B 47/06

[58] Field of Search ..... 166/53, 314, 250, 224 R

[56] References Cited

UNITED STATES PATENTS

| | | | |
|---|---|---|---|
| 2,251,244 | 7/1941 | Stanley | 166/314 |
| 2,519,242 | 8/1950 | Garrett et al. | 166/224 UX |
| 2,962,099 | 11/1960 | Clark, Jr. | 166/224 |
| 3,025,798 | 3/1962 | Coberly et al. | 166/53 |
| 3,090,316 | 5/1963 | Montgomery | 166/314 |
| 3,318,386 | 5/1967 | Garrett et al. | 166/314 |

*Primary Examiner*—Stephen J. Novosad
*Assistant Examiner*—George A. Suckfield
*Attorney, Agent, or Firm*—Marcus L. Bates

[57] ABSTRACT

A subsurface control which can be installed and retrieved from the interior of a borehole by a wireline. The apparatus is preferably located at the bottom of the borehole and controls production by a pulse flow type operation which shuts in the well prior to reaching the critical flow rate. The apparatus more efficiently utilizes well energy in lifting liquid to the surface of the ground, and includes means therein which cyclically operates in response to flow rate and bottomhole pressure. In one embodiment of the invention, the apparatus is used in combination with a free traveling plunger.

15 Claims, 4 Drawing Figures

SUBSURFACE FLOW CONTROL APPARATUS

BACKGROUND OF THE INVENTION

There are many hydrocarbon producing wells which are incapable of sustaining a velocity within the production tubing which is in excess of the critical flow rate of the well. Hence the velocity is insufficient to prevent generation of a liquid column or hydrostatic head which accumulates within the production tubing and eventually loads up the well. These wells usually are referred to as low-volume gas wells or high GOR (gas-oil ratio) oil wells. In such an instance, liquid progressively accumulates within the production string, and eventually the accumulated hydrostatic head will attain a value which essentially "shuts in" or kills the well.

A well that loads up with liquid can be pulse flowed by charging the borehole annulus with compressed gaseous fluid, such as natural gas, whereupon the production string can then be opened to the production outflow line, and the liquid slug expelled from the bottom extremity of the borehole. Of course, the pressure of the added gaseous product must be of a magnitude to produce a flow rate of a velocity which will unload the accumulated liquid slug from the well tubing.

Generally, wells of this nature are operated on a time cycle and must rely upon pressure being effected each cycle within the entire tubing string and annulus in order to unload a logged-in or dead well. This expedient is time consuming and wasteful of gas, as well as periodically causing the outflow line to be momentarily overloaded. Accordingly, this undesirable solution also causes other problems, such as difficulty in correctly attaining proper gas measurements at the meter run, and interference with the operation of other downstream equipment and apparatus.

Accordingly, it is desirable to have made available a system and method of subsurface well control and operation which is responsive to changes in both surface and subsurface pressures, and which employs a minimum producing flowing bottomhole pressure, so that an optimum amount of gas and liquid is automatically produced from the well bore.

SUMMARY OF THE INVENTION

Figure 1:
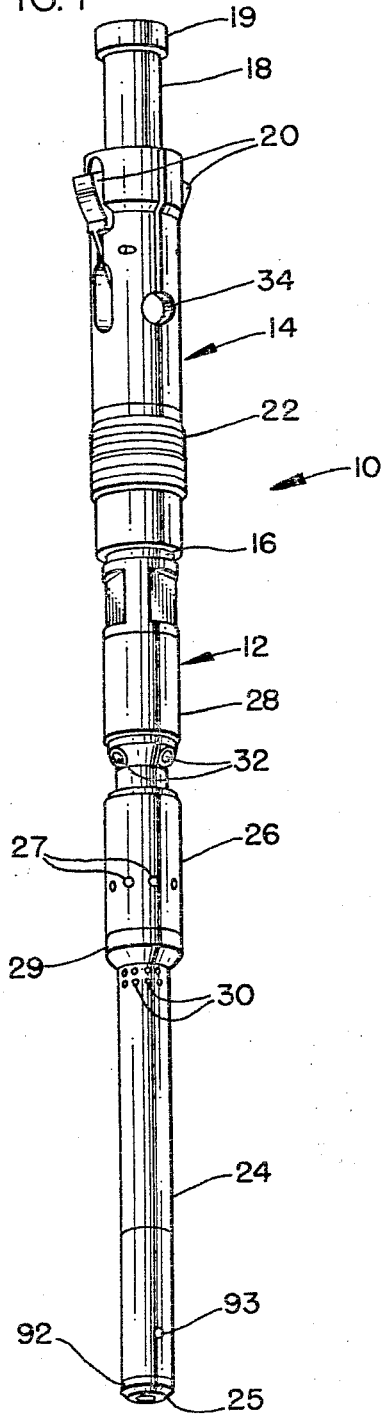
FIG. 1 is a pictorial side view of a control apparatus made in accordance with the present invention.

This invention relates to method and apparatus for producing a well, and specifically to a subsurface flow controller which can be installed and retrieved by wireline. The apparatus is located at the bottom of the borehole in proximity to the casing perforations, and controls flow therethrough and into the production tubing string. The apparatus includes means therewithin which opens a flow valve in response to a predetermined downhole pressure, and continues to flow the well until the flow rate therethrough diminishes to a predetermined value, whereupon the apparatus shuts in the well until the production reservoir or an extraneous source of gas pressure again charges the borehole annulus with a suitable magnitude of gas pressure.

In one embodiment of the invention, the apparatus is used in combination with a free-traveling plunger device so that the well bore is maintained clean, and the accumulated liquid slug is more efficiently lifted to the surface of the ground.

The flow controller has an axial fluid conducting passageway formed therein and is sealingly mounted respective to the production tubing string to force any flow which occurs through the production string to also travel through the axial passageway.

The axial passageway is divided into a piston chamber, a production inlet chamber, and a production outlet chamber. The piston chamber has a piston reciprocatingly received therein which divides the chamber into an upper and a lower piston chamber. A pilot valve means, actuated in response to downhole pressure, controls flow of production fluid into the lower piston chamber.

A valve seat separates the production outlet chamber from the production inlet chamber; and, a valve element actuated by the piston controls fluid flow through the axial passageway. Hence upstream and downstream forces act on the piston, and by suitably sizing the various springs and port sizes associated with the apparatus, closure of the controller can be effected responsive to a particular flow rate through the tubing string. This also enables adjustment of the cycle of operation of the device, which can be made to coincide with the critical flow rate of the well so as to avoid logging.

A primary object of the present invention is to provide a system by which more efficient use of well energy is utilized in lifting liquid to the surface of the earth.

Another object of the invention is to provide a more efficient subsurface controller apparatus for producing wells.

A further object of this invention is to disclose and provide a system of operation for producing gas wells by cyclically flowing the well in response to the flow rate and the downhole pressure.

A still further object of this invention is to provide a downhole control device which flows a producing well in response to downhole pressure and reservoir conditions.

An additional object is to provide method and apparatus for pulse flowing a well by utilizing pressure differentials between the reservoir and production tubing and a minimum predetermined flow rate for the cyclic operation thereof.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

DETAILED DESCRIPTION OF THE PREFERRED EMBODIMENTS

In FIG. 1 there is disclosed a flow controller means 10 which can be connected to the tubing string of a wellbore for controlling production therefrom. The controller in the embodiment of FIG. 1 comprises a valve body assembly 12 connected to a retrievable locking device 14, such as seen in Figure PF 18 on page 515, Baker Catalog, 1970-71, Baker Oil Tool, Houston, Texas. The body and the locking device threadedly engage one another at 16. A fishing neck 18 defines the upper extremity 19 of the apparatus, while radially disposed latches 20 enable the tool to be landed on a landing nipple and latched into position by utilizing techniques known to those skilled in the art. Seals 22 prevent fluid flow externally about the apparatus so that produced fluid is forced to flow internally through the tool.

The lower marginal terminal end of the controller comprises a sensor element 24 having a lowermost end portion 25. A piston chamber is formed within member 26, and the chamber is communicated with the lower borehole by means of radially spaced, horizontally disposed bleed ports 27.

A main production inlet chamber-forming portion 28 of the main body is joined to a piston chamber-forming portion of the body by the illustrated reduced diameter inlet section of the apparatus. The lower end of the piston section is reduced in diameter at 29, and spaced therefrom are a series of radially spaced-apart pilot valve inlet ports 30.

Radially spaced-apart main flow inlet ports 32, hereinafter called chokes, are spaced from a series of outflow ports 34, with the beforementioned seals being interposed therebetween.

Figure 2:
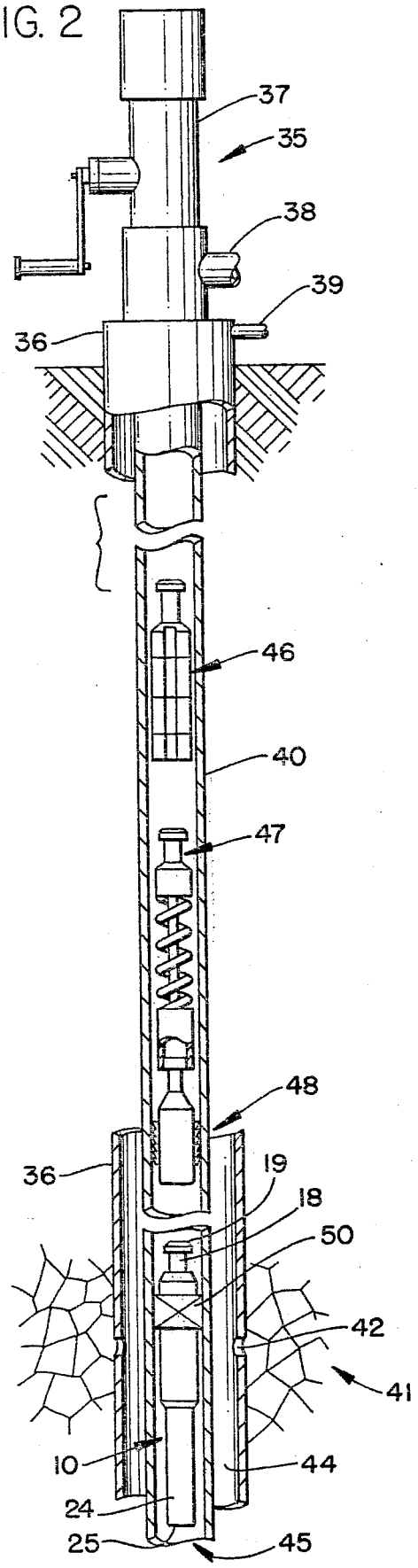
FIG. 2 is a diagrammatical representation of a wellbore having apparatus disposed therein which enables several different ones of the embodiments of the present invention to be practiced.

Looking now to the details of FIG. 2, there is schematically or diagrammatically illustrated a wellhead 35, sometimes called a Christmas Tree. The wellhead is supported by a casing 36, from which there upwardly depends a lubricator 37, known to those skilled in the art. Production outlet 38 is connected to the usual tank farm by a gathering system, while the casing annulus is provided with the usual piping 39.

Production tubing string 40 communicates with the lubricator and production outlet pipe and extends downhole in underlying relationship respective to a production formation 41. A series of perforations 42 communicate the formation with the casing or borehole annulus 44. Hence fluid flow from the formation occurs as indicated by the arrow at numeral 45.

In one preferred embodiment of the invention, there is reciprocatingly received within the upper portion of the production tubing a free-traveling plunger 46. A plunger stop or bumper 47 is anchored at 48 to the interior of the tubing string. The apparatus 46–48, along with the lubricator, can be made in accordance with the Gregston U.S. Pat. No. 3,473,611.

A packoff 50, which preferably includes a landing nipple, enables the apparatus of the invention to be installed and retrieved by wireline operation in a manner known to those skilled in this particular art.

Figure 3:
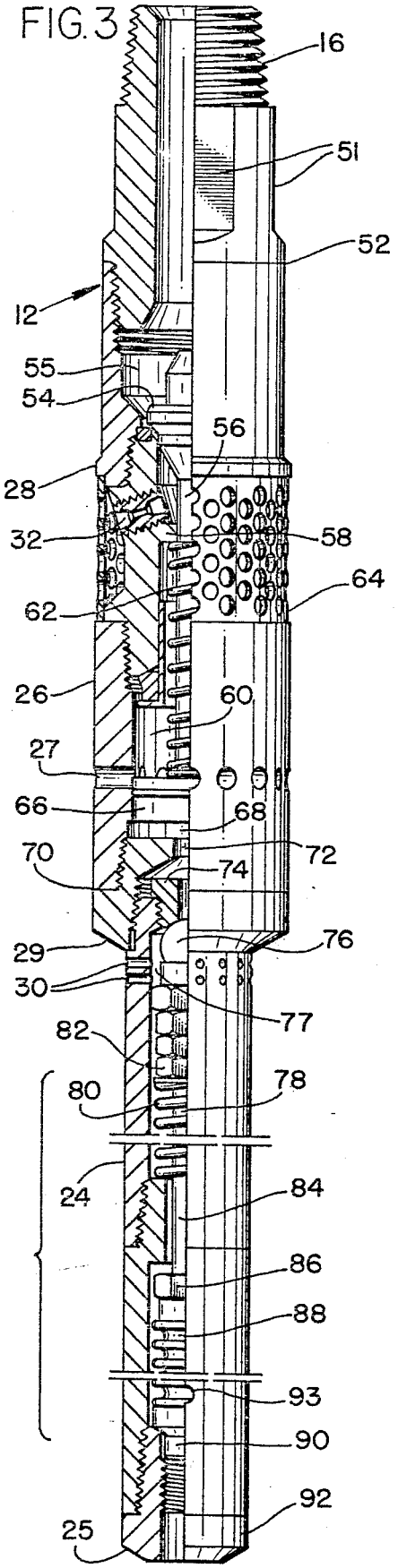
FIG. 3 is a longitudinal, part cross-sectional view of part of the apparatus disclosed in FIGS. 1 and 2; and, FIG. 4 is a part-diagrammatical, part-schematical representation of the apparatus disclosed in FIG. 3, which enables the theory of operation thereof to be better appreciated.
Figure 4:
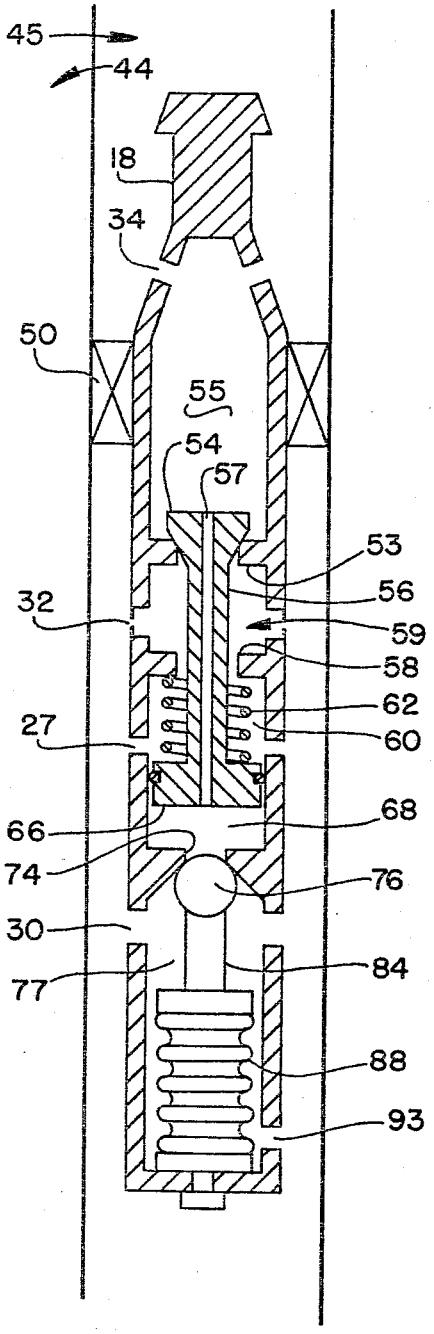

Looking now to the details of FIGS. 3 and 4, the flow controller according to this embodiment of the present invention is seen to comprise a main body having wrench flats 51 formed on the illustrated sub, with interface 52 being effected by the mating of the sub and the remainder of the tool. A production valve seat 53 sealingly receives a production flow control valve element 54 and controls fluid flow through a production outflow or outlet chamber 55.

Valve stem 56 is provided with an axial passageway 57, which is co-extensive with the valve and valve stem. The valve stem extends through the shoulder 58 which defines the lowermost portion of the production inlet chamber 59.

An upper piston chamber 60 receives a compression spring 62 therein. Screen 64 circumferentially extends about the reduced diameter choke-receiving portion of the apparatus. Piston 66 divides the piston chamber into the beforementioned upper and the illustrated lower piston chamber 68, with an interface 70 defining the lower edge portion of the piston chamber-forming portion of the main body.

Axial flow port 72 defines the lower extremity for the lower piston chamber and is in fluid communication with a pilot ball seat 74. A pilot ball valve element 76 controls flow from pressure sensor chamber 77 and is connected to a bellows 88 by means of a pilot valve shaft 78. Pilot valve spring 80 is provided with adjustments nuts 82 so that the biasing force thereof can be adjusted. The pilot valve shaft continues at 84 where it threadedly engages nut 86 of the pressure actuated or pressure responsive bellows. The end 90 of the bellows is seated in the illustrated manner of FIG. 3 and secured within the tool by a lower end portion 92 of the tool. A bleed hole 93 contributes to effecting bottomhole pressure upon the bellows.

The bellows is arranged respective to shaft 84 in such a manner that increased bottomhole pressure moves the shaft in a downward direction, thereby unseating the ball from the ball seat. It will be noted that like or similar numerals, wherever possible, relate to like or similar numerals throughout the figures of the drawings.

As best understood by studying FIGS. 1 and 2, the present invention is installed on the illustrated landing nipple by engaging the fishing neck of the controller assembly with a wireline actuated fishing tool and running the controller downhole until it is sealingly received in a seated manner within the packoff device 50. Where a free plunger is used in conjunction with the controller, the plunger bumper is next wireline installed in a similar manner and thereafter a free-traveling plunger dropped through the lubricator, after which the lubricator is capped and the well is ready to be put into production.

As the hydrocarbon-producing formation produces fluid, both liquid and gas will accumulate downhole. The liquid will rise within the annulus, while at the same time, the gas pressure within the annulus will increase. It will be noted during this stage of the shut-in operation that both the pilot and the main flow valves are seated; and accordingly, downhole pressure is effected on the bellows 88 by means of port 30 or 93. Spring 80 maintains the ball valve sealingly engaged against its seat, while spring 62 biases piston 66 in a downward direction, thereby maintaining the valve element 54 sealingly engaged against its corresponding seat. Furthermore, the tubing pressure uphole the packer device 50 is at a reduced pressure, depending upon the pressure effected within the outflow line 38, and the hydrostatic head of any fallback liquid.

When the downhole pressure below the controller, as for example, the formation pressure, reaches a predetermined set pressure, the compressive force of spring 80 will be overcome, thereby progressively unseating the pilot or ball valve from its attendant seat. Usually, liquid will have accumulated and will therefore extend a considerable height above the perforations; and accordingly, liquid fluid flow will now occur into port 30, through valve seat 74, into lower piston chamber 68, where the pressure thereof is effected against the lower surface of the piston. However, since chambers 68 and 55 communicate with one another by means of axial valve stem passageway 57, liquid flow will occur into production outlet chamber 55 and through the production outlet ports 34, where the liquid will flow to some elevation above the controller, depending upon when the set spring pressures permit the production valve to move to the open position.

Should a plunger device be included in the combination, this sequence of events causes liquid to slowly rise above the plunger, which presently remains seated against the bumper assembly 47. The previous fallback liquid resulting from the previous cycle of operation will co-mingle with the new production fluid. As downhole pressure progressively increases, the bellows will continue to move the pilot valve shaft in a downward direction until the pressure within chamber 68 reaches a value whereby the pressure differential across the valve 54 will cause the piston 66 to move in an upward direction. As the piston moves, valve 54 is unseated from its corresponding seat 53, thereby allowing fluid to flow through the chokes, through the production inlet chamber, through the production valve seat, into the production outlet chamber, through the outlet production ports, and up through the tubing string. Flow across valve seat 53 reduces the pressure within the chamber 59, and as the piston covers the pilot ports 27, a sudden pressure differential across the piston is effected, thereby driving the piston in an upward direction with a snap action. As the piston moves above and uncovers ports 27, the entire bottomhole pressure is effected against the lower face of the piston; and consequently, the pressure drop across the piston now equals the pressure differential measured between the well bottomhole and the interior of the tubing string. The compressed gas within the annulus causes an inrush of flow to occur through the chokes, through the main valve, and up the tubing string, carrying therewith the traveling plunger, the slug of liquid, and produced gas.

Gaseous production, along with any entrained liquid, continues in this manner until the bottomhole pressure diminishes to a value in excess of, but close to, the critical flow value of the well. At some preselected reduced set pressure, the bellows 88 will move shaft 84 in an uphole direction to seat the ball valve; however, the pressure within chamber 68 will not be reduced at this time, because the piston 66 is above the ports 27; and therefore, the piston pressure differential remains dependent upon the above stated variables. As the pressure drop across the piston diminishes to some preselected value, it will be forced by the compression spring back into the illustrated position of FIG. 4. This expedient causes the main flow valve to close with a snap action; whereupon the well is shut in for a length of time which is dependent upon the spring force, whereupon the controller is in standby configuration awaiting pressure buildup to cause the next cycle of operation to commence.

Those skilled in the art, having digested the foregoing portions of this disclosure, will appreciate that the selected spring forces 62 and 80, along with the choke size 32, the size of the orifice or flow passageway 57, together with the relative areas of the opposed sides of the piston can be correlated respective to one another to cause the main flow valve to open at any set downhole pressure and to cause the flow valve to close at any selected reduced flow rate through the apparatus. Closure of the main flow valve should be set to occur at or above the critical flow rate, of course. As indicated above, the pilot section of the controller opens on any preset pressure and closes at some reduced pressure after providing the function of opening the main flow valve. The main flow valve, once it has opened, remains open regardless of the position of the pilot section until the flow rate through the controller reduces to a value which moves the piston to a position which closes the main flow valve. Hence it may be said that the main flow valve closes on any preset flow rate to shut in the well for a predetermined time interval which is determined by increased downhole pressure. In other words, a selected downhole pressure indirectly opens the main flow valve, while the flow rate through the tool closes the main flow valve, with these conditions of operation being sensed downhole adjacent to the production formation. The controller can be anchored in a sealing manner downhole by using a landing nipple, a packoff device, or any other desired expedient, so long as flow occurs through the controller in the above illustrated manner.

While the present invention finds maximum utility in weak wells having a large GOR which must be stopcocked or pulse flowed, it can also be used in any fluid producing well as a means of controlling the production rate, regardless of the GOR. In extreme examples, the controller can produce wells having low gas pressure by extraneously supplying the casing annulus pressure.

It is evident that the present invention is opened in response to a selected maximum downhole formation pressure being generated, and the well is shut in upon any selected minimum flow rate, which usually will be a flow rate which is close to, but greater than, the critical flow rate of the well. The shut-in period of the cyclic operation enables formation fluid from the production zone to accumulate downhole in the borehole annulus. The critical flow rate as used in this disclosure is intended to include a rate of flow where insufficient velocity through the tubing string is available to carry liquid to the surface by entrainment; and accordingly, liquid has commenced to accumulate downhole in the tubing string and within the casing, and the liquid hydrostatic head ultimately reaches a value to render the well dead if production is continued. A well that has been killed by undue hydrostatic head often must be bled to the atmosphere and unloaded by pumping an enormous amount of gaseous products into the casing annulus so as to force the liquid slug to the surface of the earth. This is an expensive endeavor, and heretofore it has been unknown to those skilled in the art to avoid this condition according to the instant invention.

An important aspect of the present invention is in the standing valve action of the controller. Fallback of liquid each cycle of operation is prevented from flowing back into the casing annulus and effectively increasing the hydrostatic head; accordingly, efficiency of operation is greatly improved by the "standing valve action" of the present invention. The present invention provides further advantages in that all of the pressure from the reservoir is maintained below the liquid slug;

thereby enabling the well energy to be utilized in lifting the slug of liquid to the surface of the earth. This advantage is not realized with a surface type controller.

The present invention completely eliminates all requirements for any surface control equipment, and in most cases plungers, by the provision of a downhole controller which senses downhole pressure and downhole flow rates in proximity of the production zone, and regulates flow of production fluid according to selection of optimum downhole operating variables. By controlling liquid accumulation within the borehole, the well production can be carried out with lower pressure differentials than is possible with surface type controls or plungers.

I claim:

1. In a borehole having a fluid producing formation located downhole therein, and a production tubing extending downhole into proximity of the formation, with the tubing forming a produced fluid flow path and a borehole annulus, the improvement comprising:

a subsurface flow controller for controlling flow of fluid from the formation into the tubing string, said controller being in the form of a fluid-conducting hollow body and having an upper and lower end portion, said hollow body having means forming a piston chamber, a production inlet chamber, and a production outlet chamber therewithin;

said piston chamber having a piston reciprocatingly received therewithin and dividing the last said chamber into an upper and a lower piston chamber;

a pilot valve means actuated in response to downhole pressure for controlling produced fluid flow into and out of said lower piston chamber;

a production valve seat separating said production outlet chamber from said production inlet chamber, a production valve element having means by which it is actuated by said piston from an opened to a closed position for controlling fluid flow through said production valve seat; a choke forming a produced fluid inlet into said production inlet chamber; means forming a bleed port which is arranged respective to the piston so that downhole pressure is effected within said upper piston chamber when said production valve is closed and which is effected within said lower chamber when said production valve is moved to the open position; and means biasing said production valve element towards the closed position;

so that increased bottomhole pressure opens said pilot valve to cause said piston to open said production valve element, so that fluid flow can occur through said production valve seat until a reduced flow rate through the last said seat causes the production valve element to assume a closed position.

2. The improvement of claim 1 and further including means forming a passageway through said valve element for flow connecting said production outlet chamber and said lower piston chamber so that flow can occur therebetween when flow occurs through said pilot valve.

3. The improvement of claim 2 wherein said pilot valve means includes means by which it is adjustably spring loaded towards the closed position so that the opening force can be regulated.

4. The improvement of claim 1 wherein said pilot valve means is a pressure sensor and includes means connected thereto to cause it to open in response to increased pressure being effected downhole by the formation.

5. The improvement of claim 1, and further including means by which said pilot valve means is adjustably spring loaded towards the closed position so that the opening force can be regulated;

said pilot valve means is a pressure sensor which includes means connected thereto to cause it to open in response to increased pressure being effected downhole by the formation.

6. The improvement of claim 1 and further including means forming a passageway for connecting together said production outlet chamber and said piston chamber so that flow occurs therebetween when said pilot valve is open;

said pilot valve means being adjustably spring loaded toward the closed position so that the opening force thereof can be regulated.

7. The improvement of claim 1 wherein said pilot valve means is spring loaded toward the closed position so that the opening force can be regulated;

said pilot valve means includes a pressure sensor having a bellows means which is connected to open said pilot valve upon reaching an increased pressure;

and an orifice means for connecting said production outlet chamber and said lower piston chamber together in fluid flow relationship so that flow can occur therebetween when said pilot valve is moved to the opened position.

8. The improvement of claim 1 and further including a traveling plunger within the production tubing at a location above said controller; a plunger arrester, a plunger lubricator, said plunger arrester being anchored above said controller and below said plunger in spaced relation to said lubricator, said lubricator being affixed to an upper end portion of said tubing string;

so that said controller can cause said plunger to travel uphole into the lubricator when sufficient downhole pressure is effected thereon.

9. Method of controlling mixed liquid and gaseous fluid flow from a producing formation located downhole in the borehole, wherein the produced fluid flows uphole through a production tubing string, comprising the steps of:

1. locating a flow controller downhole in a borehole in proximity of the production formation;
2. connecting the flow controller to the tubing string so that fluid flow through the tubing string is controlled by the action of the controller;
3. sensing the formation pressure and moving the flow controller to a fluid flow position in response to the bottomhole pressure increasing to a value which will expel most of the accumulated liquid from the borehole;
4. sensing the flow rate through the tubing string and moving the controller to a position to prevent fluid flow through the tubing string in response to the flow rate decreasing to a value which is in excess of a rate of flow where insufficient velocity through the tubing string is available to carry liquid to the surface by entrainment.

10. The method of claim 9 wherein step (3) further includes the steps of providing a small flow path for liquid flow and thereafter providing a large flow path for mixed gaseous and liquid flow.

11. The method of claim 9 and further including the step of:

5. positioning a traveling plunger above the controller so that the plunger can aid in lifting fluid uphole through the production tubing string.

12. The method of claim 9 and further including the steps of:

5. providing a small flow path for liquid flow and thereafter providing a large flow path for mixed gaseous and liquid flow; and
6. positioning a traveling plunger above the controller so that the plunger can aid in lifting fluid through the production tubing.

13. Method of producing a well which produces mixed gaseous and liquid fluid through a tubing string by cyclically opening and closing the tubing string to flow therethrough according to the following steps:

1. producing the well through the tubing string while sensing the flow rate downhole in the borehole;
2. closing the tubing string to flow when the flow rate therethrough has decreased to a value which tends to accumulate liquid therewithin;
3. sensing the formation pressure at a location downhole in the borehole;
4. continuing the shut-in condition of the borehole until sufficient pressure has accumulated in the borehole annulus to expel substantially all accumulated liquid therefrom when the tubing string is again opened to flow;
5. repeating steps (1)–(4) so that the well is cyclically produced.

14. The method of claim 13 wherein the flow through the tubing is controlled according to the following steps:

5. placing a flow controller in series flow relationship respective to the tubing;
6. carrying out step (3) by sensing the formation pressure at a location between the controller and the formation.

15. The method of claim 13 wherein step (2) is carried out by:

7. sensing the pressure differential between the bottomhole pressure and the tubing string pressure and closing the tubing string to flow when the pressure differential is reduced to a value indicative of the flow rate set forth in step (2).

* * * * *